US006779922B2

(12) United States Patent
Gates

(10) Patent No.: US 6,779,922 B2
(45) **Date of Patent: *Aug. 24, 2004**

(54) BAG FOR AUTOMATED FILLING AND SEALING MACHINE

(75) Inventor: Anthony H. Gates, Atwater, OH (US)

(73) Assignee: Gates Automation, Inc., Sebring, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/764,705

(22) Filed: Jan. 18, 2001

(65) Prior Publication Data

US 2001/0038723 A1 Nov. 8, 2001

Related U.S. Application Data

(63) Continuation-in-part of application No. 09/563,614, filed on May 2, 2000, now Pat. No. 6,318,893.

(51) Int. Cl.[7] ..... B65D 33/00

(52) U.S. Cl. ..... 383/200; 383/7; 383/61.1; 383/903

(58) Field of Search ..... 383/200, 903, 383/33, 107, 108, 37, 94, 203, 204, 209, 9, 61.2, 210, 210.1, 61.1, 7; 206/554; 493/237; 53/469

(56) References Cited

U.S. PATENT DOCUMENTS

| | | | | | |
|---|---|---|---|---|---|
| 2,329,360 | A | * | 9/1943 | Salfisberg | 206/484 |
| 2,542,206 | A | * | 2/1951 | Nichols | 206/484 |
| 3,342,326 | A | | 9/1967 | Zackheim | |
| 3,625,351 | A | * | 12/1971 | Eisenberg | 206/484 |
| 3,751,875 | A | * | 8/1973 | Membrino | 383/37 |
| 3,768,725 | A | * | 10/1973 | Pilaro | 206/439 |
| 3,799,914 | A | * | 3/1974 | Schmit et al. | 215/376 |
| 4,176,567 | A | * | 12/1979 | Weisberg | 383/200 |
| 4,524,459 | A | * | 6/1985 | Titchenal | 383/122 |
| 4,588,392 | A | | 5/1986 | Maddock | |
| 4,598,421 | A | * | 7/1986 | Jostler | 383/37 |
| 4,634,006 | A | * | 1/1987 | Yanase | 378/64 |
| 4,652,253 | A | | 3/1987 | Benoit | |
| D306,555 | S | * | 3/1990 | Lane et al. | D9/305 |
| 4,986,673 | A | * | 1/1991 | Bell | 383/204 |
| 5,059,036 | A | * | 10/1991 | Richison et al. | 383/102 |
| 5,118,203 | A | * | 6/1992 | Andronico | 383/210.1 |
| 5,224,779 | A | * | 7/1993 | Thompson et al. | 383/5 |
| 5,470,419 | A | * | 11/1995 | Sasaki et al. | 156/244.12 |
| 5,673,541 | A | * | 10/1997 | Arzuman et al. | 53/284.7 |
| 5,711,751 | A | | 1/1998 | Harmanoglu | |
| 5,733,045 | A | * | 3/1998 | Jostler et al. | 383/37 |
| 6,021,628 | A | * | 2/2000 | Jostler et al. | 53/133.4 |
| 6,244,746 | B1 | * | 6/2001 | Tokita et al. | 383/1 |
| 6,318,893 | B1 | * | 11/2001 | Gates | 206/554 |

* cited by examiner

*Primary Examiner*—Lee Young
*Assistant Examiner*—Joseph C. Merek
(74) *Attorney, Agent, or Firm*—Sand & Sebolt

(57) ABSTRACT

A sealable bag for storing merchandise includes a body having a pocket that is adapted to receive the merchandise. The pocket has an opening through which merchandise is placed into the pocket. The body has a pair of flanges disposed along the sides of the body. The body has a neck with the opening of the pocket being disposed at the neck of the body. The neck has a sealing area. The bag includes a pair of stress relief notches disposed in the flanges intermediate the sealing area and the opening of the pocket. Each stress relief notch extends into the neck of the body. The stress relief notches prevent the sealing area from becoming wrinkled while the bag is being sealed with automated equipment thus allowing a clean, unwrinkled seal to be formed in the bag.

14 Claims, 12 Drawing Sheets

BAG FOR AUTOMATED FILLING AND SEALING MACHINE

CROSS REFERENCE TO RELATED APPLICATION

This application is a continuation-in-part application of U.S. application Ser. No. 09/563,614 filed May 2, 2000, now U.S. Pat. No. 6,318,893 the disclosures of which are incorporated herein by reference.

BACKGROUND OF THE INVENTION

1. Technical Field

The present invention generally relates to bags and, more particularly, to bags that are filled and then sealed to hermetically seal the contents within the bag. Specifically, the present invention relates to a sealable bag having a pair of stress relief areas that prevent the area of the bag that is to be sealed from being wrinkled during the sealing process. The invention also relates to the method of holding, filling, and sealing the bags.

2. Background Information

Various products are now being packaged in sealed bags that allow the consumer to break the initial seal and then selectively seal and reseal the bag with a secondary closure member. These bags are primarily fabricated from flexible plastic or metalized plastic. Some bags have gusseted bottoms that must be opened prior to filling the bag. For this reason and others, many bag filling operations have been performed manually. Problems sealing the bags in manual operations were not encountered because the person filling the bag and passing it on to the sealing machine could smooth the sealing area before the sealing machine sealed the bag.

As a result in the increased popularity of these bags, automated filling and sealing devices have been invented to increase the efficiency of filling and sealing the bags. One such machine is disclosed in pending patent application Ser. No. 60/161,772, filed Oct. 27, 1999. The disclosures of this application are incorporated herein by reference in order to fully disclose how these machines operate. In this machine, a pair of fingers grabs the top corners of the bag to pull the top of the bag taut so that it may be sealed. A problem in the art is that some bags wrinkle in the sealing area when pulled taut. The wrinkles degrade the appearance of the resulting seal and may degrade the effectiveness of the seal. Some consumers have refused to use the automated machinery to fill and seal their bags until the wrinkling problems can be solved.

SUMMARY OF THE INVENTION

The present invention provides a bag for an automated filling and sealing machine that eliminates the wrinkling problem caused by the fingers that pull the sides of the bag apart.

The bag may be used with automated filling and sealing machinery.

The invention provides a solution that may be incorporated into existing bags without requiring the existing bag structure to be altered.

BRIEF DESCRIPTION OF THE DRAWINGS

Similar numbers refer to similar parts throughout the specification.

DESCRIPTION OF THE PREFERRED EMBODIMENTS

Figure 1:
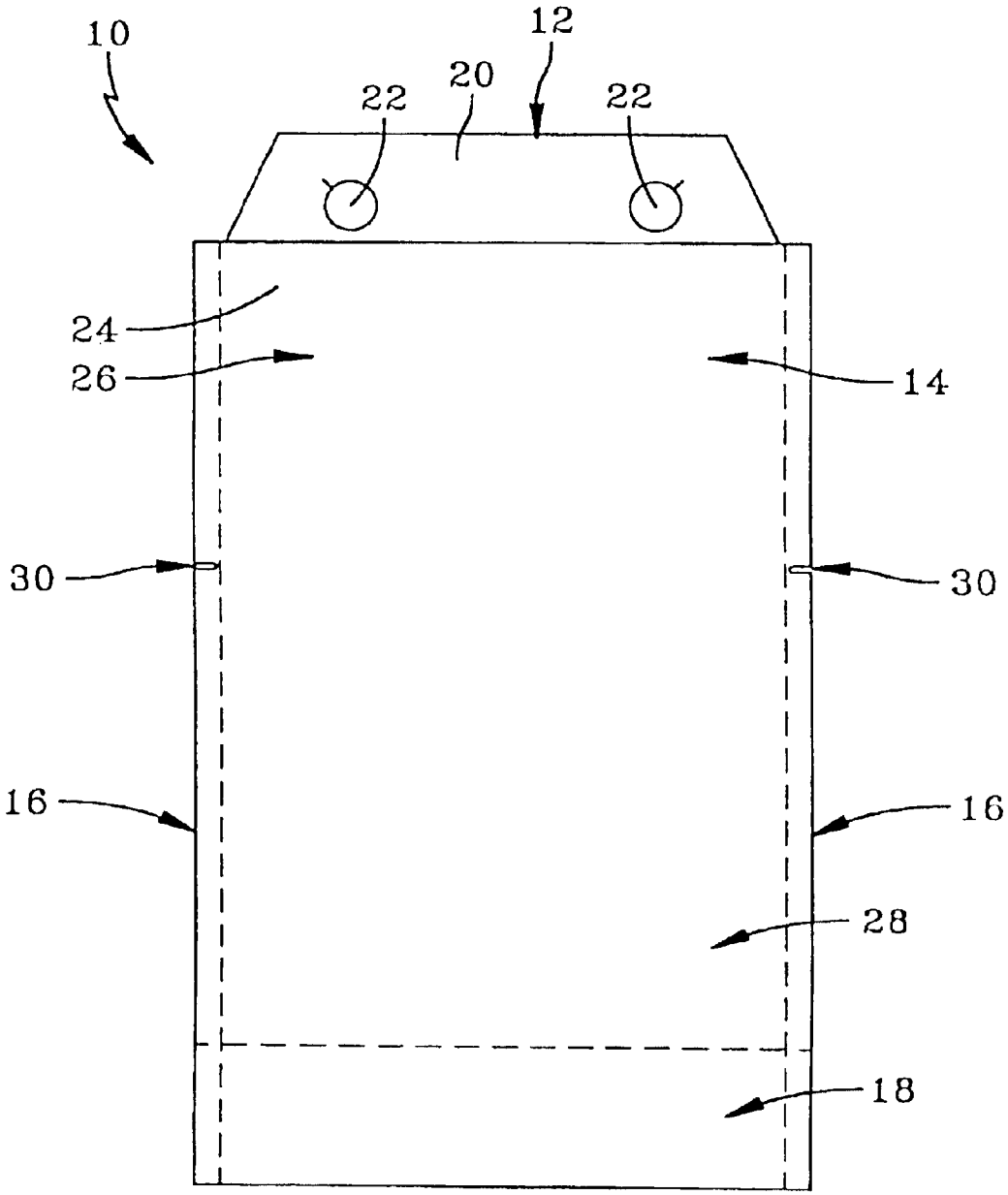
FIG-1 PRIOR ART
FIG. 1 is a front plan view of a prior art bag.
Figure 2:
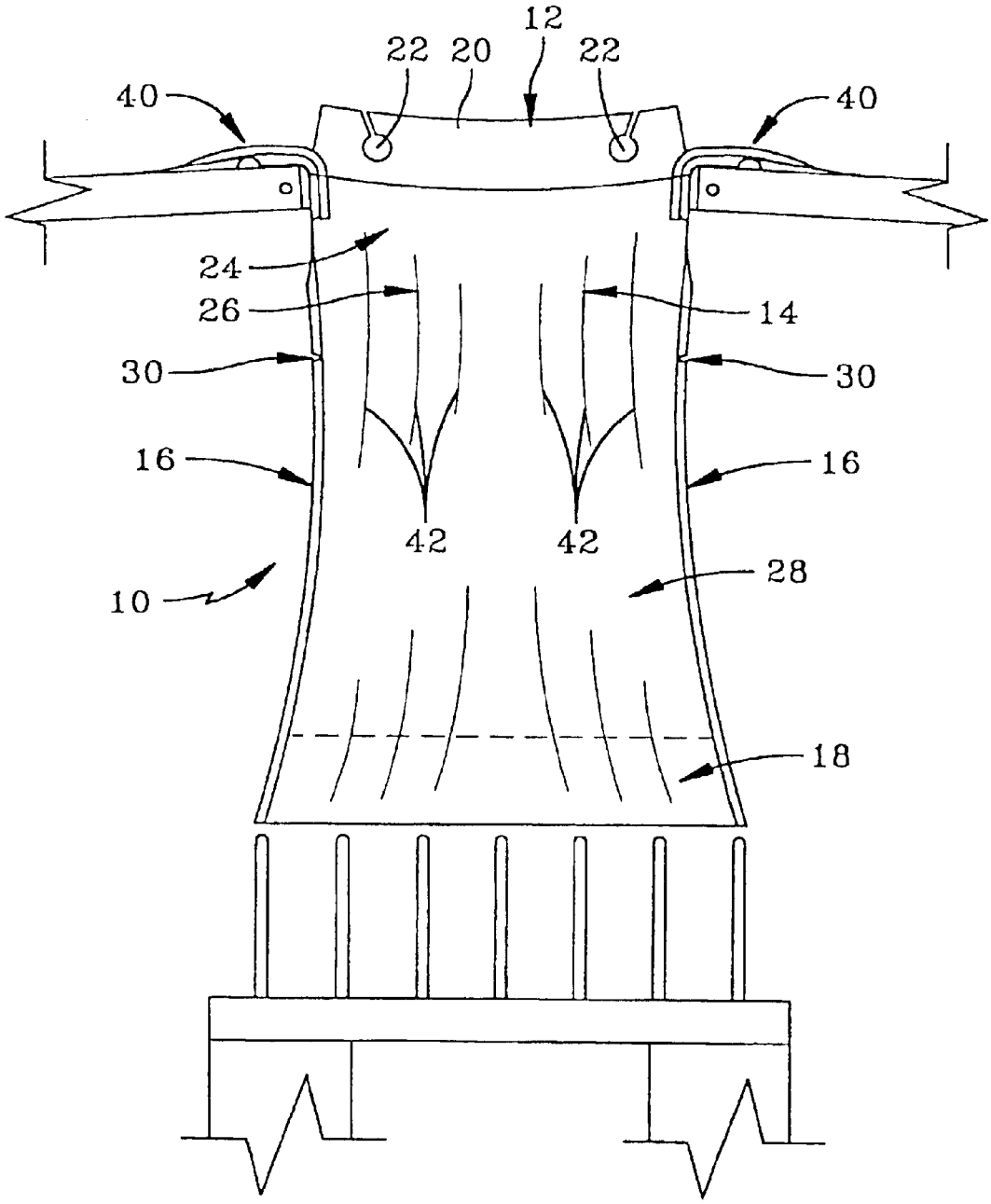
FIG-2 PRIOR ART
FIG. 2 is a front plan view of the prior art bag disposed in a filling and sealing machine with the fingers of the machine grasping the upper corners of the bag.
Figure 3:
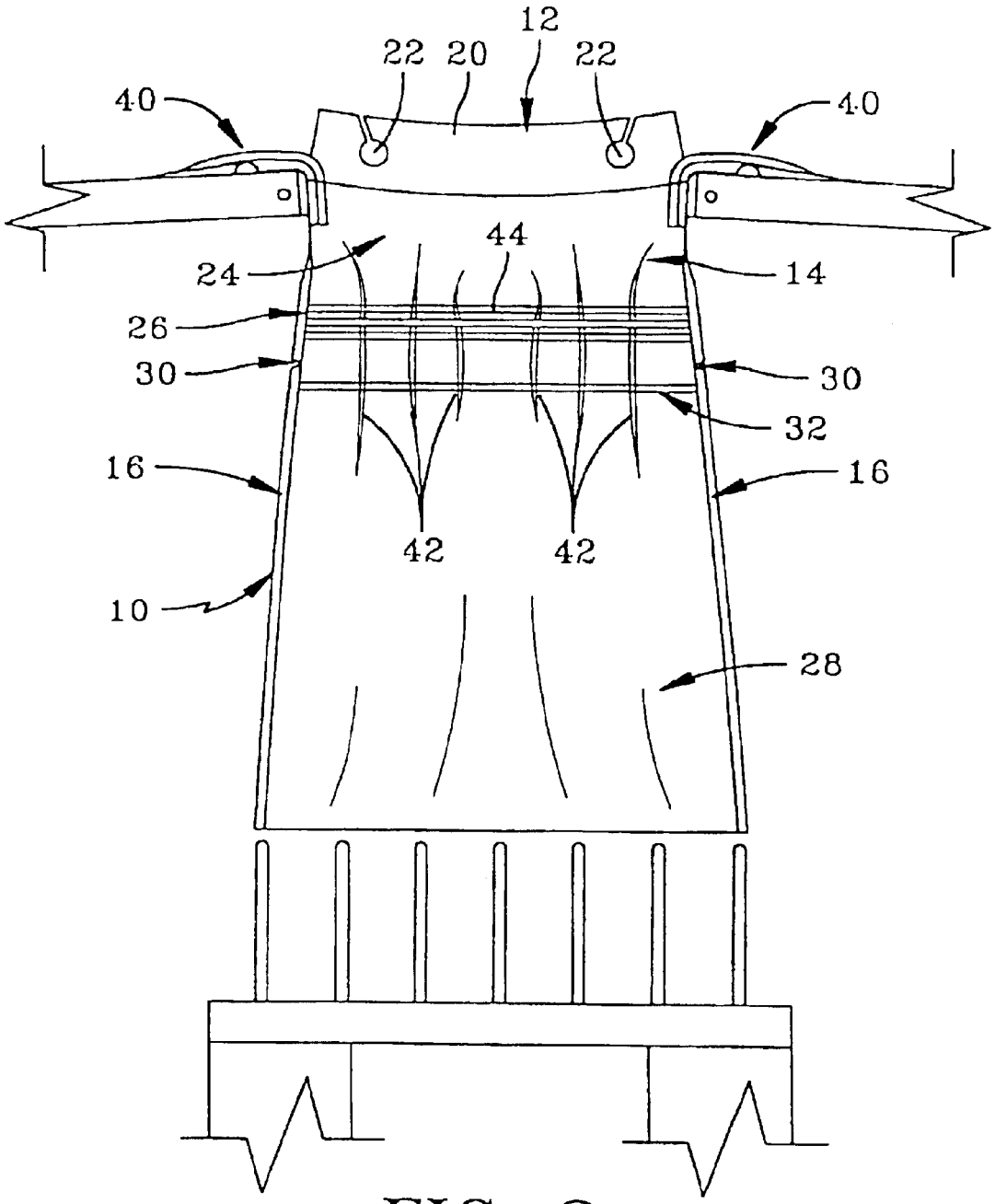
FIG-3 PRIOR ART
FIG. 3 is a view similar to FIG. 2 showing the wrinkling created in the sealing area of the prior art bag.
Figure 4:
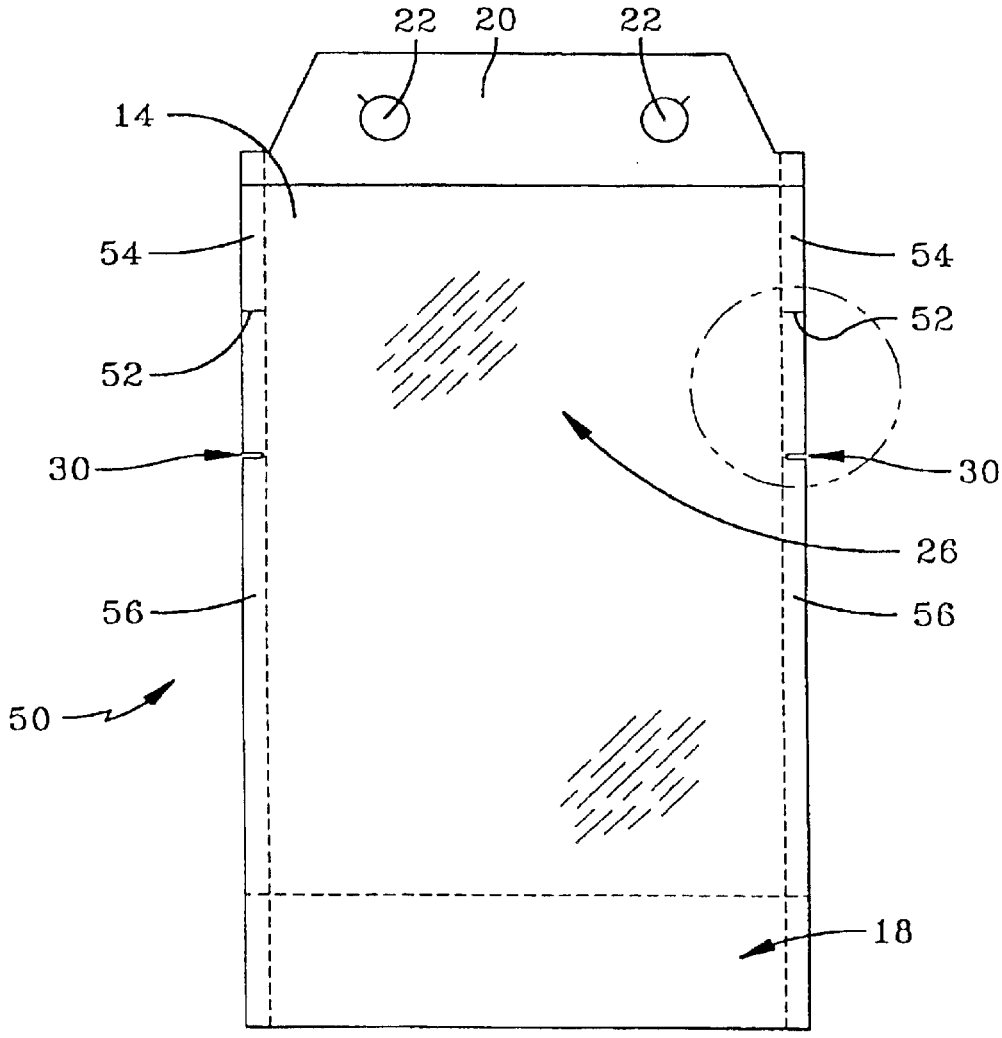
FIG. 4 is a front plan view of the bag of the present invention.
Figure 5:
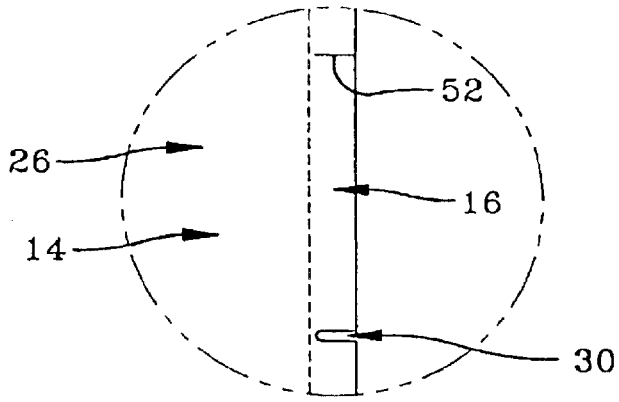
FIG. 5 is an enlarged view of the encircled portion of FIG. 4.

A prior art bag is depicted in FIGS. 1–3 and is indicated generally by the numeral 10. Bag 10 is formed from first 12 and second 14 sheets by sealing the longitudinal edges of sheets 12 and 14 and joining the bottom edges of sheets 12 and 14 to form a pocket having an open end. Sealing the edges of sheets 12 and 14 results in flanges 16 being disposed along the longitudinal edges of bag 10. In the embodiment of prior art bag 10 depicted in FIGS. 1–3, bag 10 is gusseted as indicated by the numeral 18 so that the bottom of bag 10 may be opened to provide more room for merchandise.

First sheet 12 typically includes a tongue 20 that extends out beyond the upper edge of second sheet 14. Tongue 20 generally defines a pair of openings 22 that allow bag 10 to be mounted on a wicket during storage before bag 10 is filled and sealed. Below tongue 20, bag 10 includes a neck area 24 that includes a sealing area 26. Bag 10 further includes a pocket area 28 disposed below sealing area 26. Each flange 16 defines a tear notch 30 disposed below sealing area 26 such that each tear notch 30 is disposed between sealing area 26 and pocket area 28. Tear notch 30 allows the consumer to open bag 10 after the consumer has purchased bag 10 in a retail store. A secondary seal 32 (see FIG. 3) may be formed in bag 10 to allow the consumer to selectively seal, unseal, and reseal bag 10 while the consumer is consuming the merchandise in bag 10.

FIGS. 2 and 3 show bag 10 being opened, filled, and sealed by an automated filling and sealing machine. The machine includes a pair of finger assemblies 40 that grab and pinch the upper corners of bag 10 to hold bag 10 while it is being opened, filled, and sealed. A problem with prior art bag 10 is that finger assemblies 40 fold flanges 16 back against bag 10 when bag 10 is being held by finger assemblies 40. The folding of flanges 16 results in a plurality of wrinkles 42 to be formed through sealing area 26. When a wrinkled bag 10 is passed through the sealing operation of the automated machinery, wrinkles 42 remain permanently formed in bag 10 when the seal 44 is formed by joining first sheet 12 to second sheet 14 as shown in FIG. 3. Wrinkles 42 thus degrade the appearance of bag 10 and cause fears that seal 44 may leak.

The bag of the present invention is indicated generally by the numeral 50 in FIGS. 4–8. Bag 50 includes many of the same elements described above with respect to prior art bag 10 and the same numbers are used to refer to these elements. In accordance with one of the objectives of the present invention, bag 50 includes a pair of stress relief notches 52 disposed in flanges 16 above sealing area 26 such that sealing area 26 is intermediate stress relief notches 52 and tear notches 30. Each stress relief notch 52 is preferably disposed intermediate the opening to the pocket and sealing area 26. Each stress relief notch 52 must be positioned intermediate sealing area 26 and the upper corners of bag 50. Each stress relief notch 52 divides flange 16 into an upper portion 54 and a lower portion 56.

Figure 6:
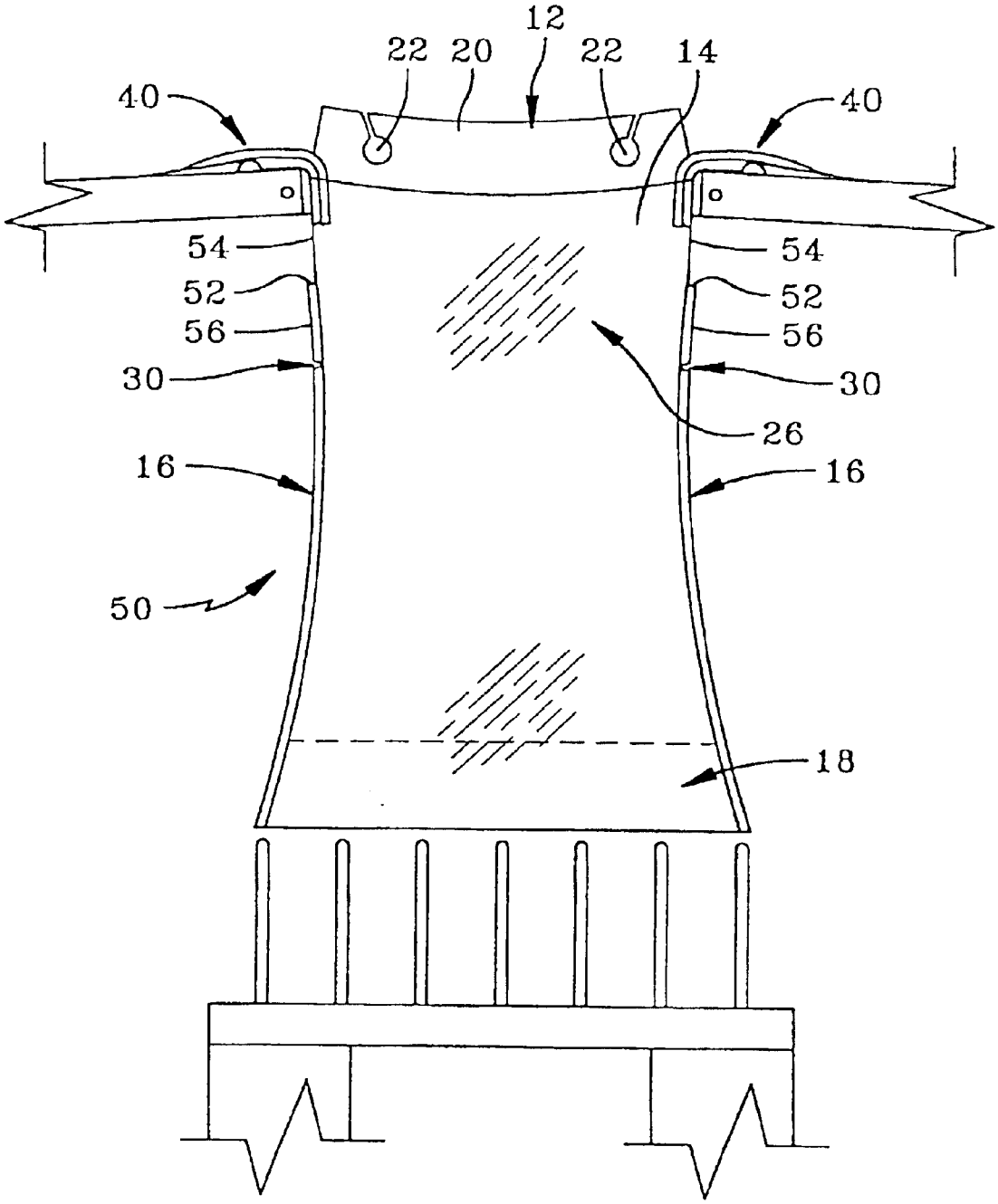
FIG. 6 is a front plan view of the bag of the present invention being held in the filling and sealing machine without creating the wrinkles of the prior art.
Figure 7:
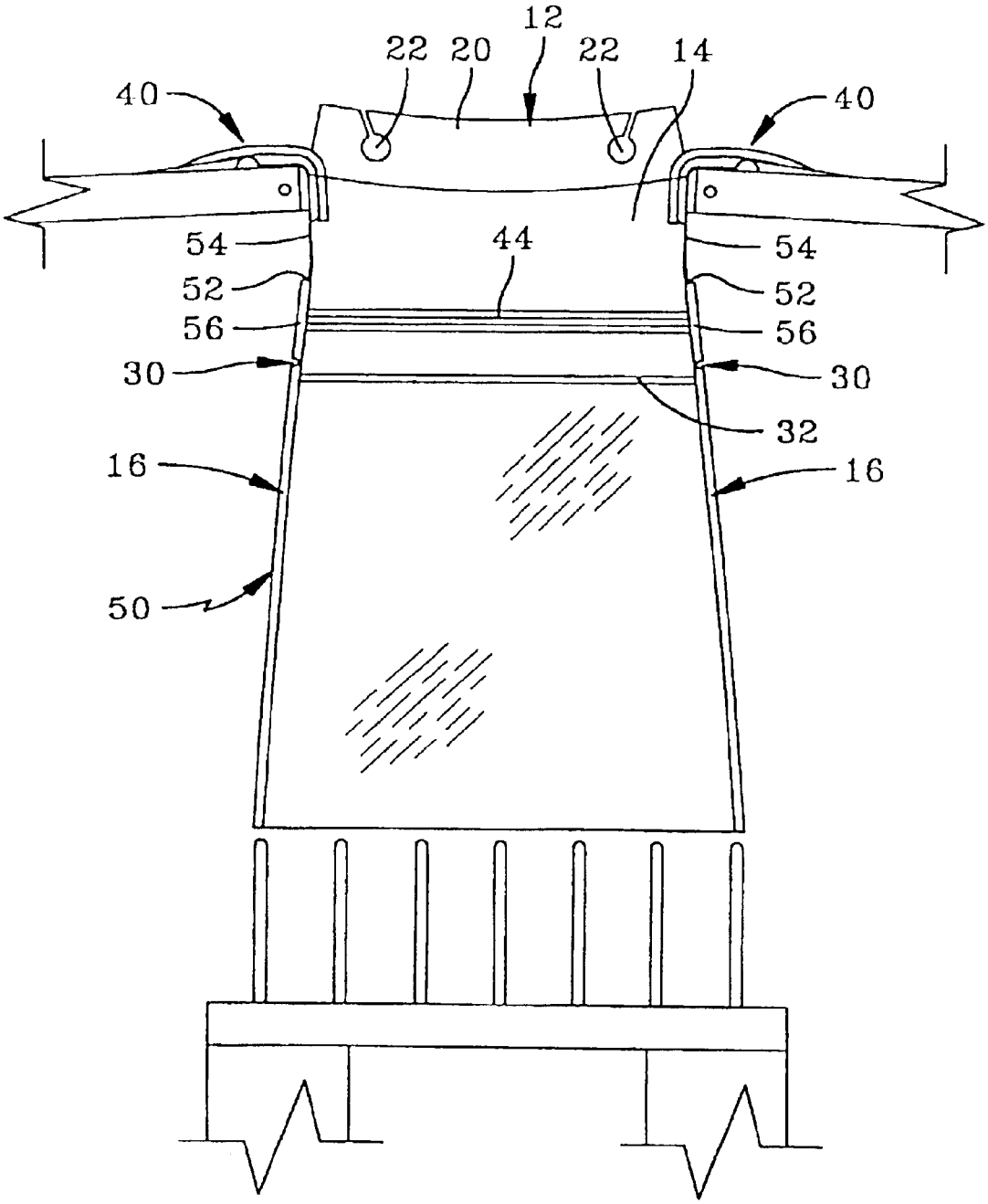
FIG. 7 is a view similar to FIG. 6 showing the bag of the present invention after it has been sealed.
Figure 8:
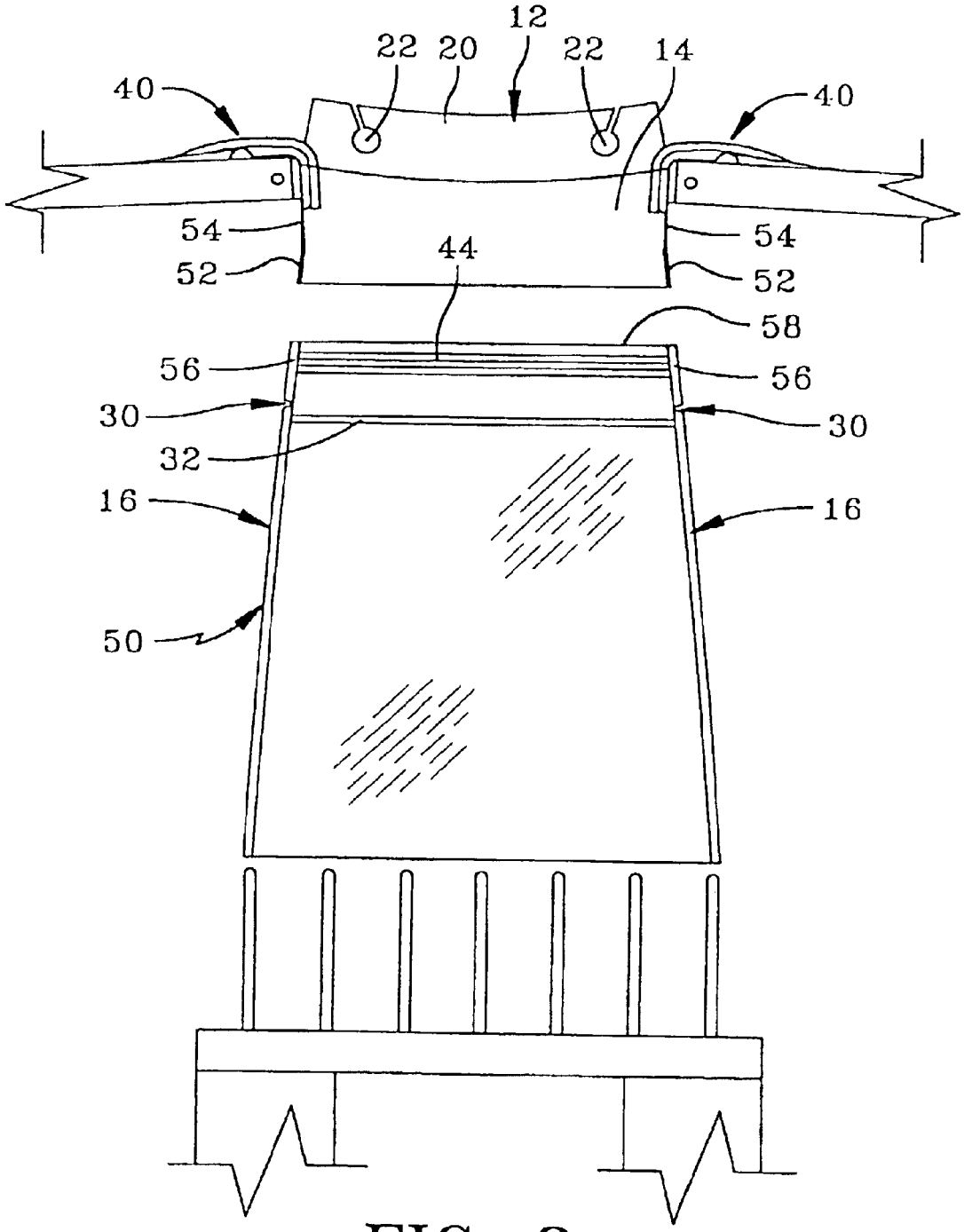
FIG. 8 is a view similar to FIG. 6 showing the bag of the present invention with the top of the neck cut away.

In accordance with the objectives of the invention, stress relief notches 52 allow upper portions 54 of flanges 16 to be folded by finger assemblies 40 without creating wrinkles in sealing area 26. Stress relief notches 52 function by allowing upper portion 54 of flange 16 to fold independent of lower portion 56 when finger assemblies 40 grab the upper corners of bag 50 as shown in FIGS. 6, 7, and 8. Sealing area 26 thus remains substantially smooth and readily accepts seal 44 as shown in FIG. 7 without the wrinkling problem of the prior art.

The top of bag 50 including tongue 20 is cut away from the sealed bag as shown in FIG. 8. The cut line 58 is preferably located intermediate stress relief notches 52 and seal 44. The consumer may then open bag 50 by cutting or tearing between tear notches 30 and using secondary seal 32 to close bag 50.

Each stress relief notch 52 preferably penetrates flange 16 a distance 50 to 90 percent of the width of flange 16. In one common embodiment of bag 50, each flange has a width of 0.25 inches with each stress relief notch having a width of 0.21875 inches. Each stress relief notch 52 is preferably disposed about one to 1 to 1½ inches below the opening of the pocket of bag 50. Stress relief notches 52 must be disposed far enough down along flanges 16 to prevent finger assemblies 40 from grabbing lower portion 56 of flange 16. Each stress relief notch 52 may be a slit as depicted in the drawings. Notches 52 may also be triangular, rounded, square, rectangular, trapezoidal, or any of a variety of other shapes.

In one exemplary embodiment, bag 50 is 11 inches long and 6 inches wide. Each flange 16 is ¼ inch with each stress relief notch 52 being 7/32 of an inch. Each stress relief notch 52 is disposed 1⅜ inch down from the top of the pocket with the top of the pocket being disposed 1½ inch from the top of tongue 20. Sealing area 26 is slightly less than 1 inch deep and extends from flange to flange. Each tear notch is disposed 4½ inches from the top of bag 50. In larger bags 50, flanges 16 may be ⅜ inch wide.

Bag 50 is filled and sealed by first grasping the upper corners of bag 50. The pocket of bag 50 may be filled with merchandise before or after the upper corners of bag 50 are grasped by finger assemblies 40. Finger assemblies 40 then move away from each other to pull neck area 24 taut. This action does not create wrinkles in sealing area 26 because upper portions 54 of flanges 16 are folded independent of lower portions 56 of flange 16 as shown in FIGS. 6–8. Bag 50 is then placed in a sealing device that creates seal 44 in sealing area 26 such that seal 44 is disposed intermediate stress relief notches 52 and tear notches 30. The top of bag 50 is then removed as shown in FIG. 8 and a clean, unwrinkled seal 44 may be presented to the consumer.

Figure 9:
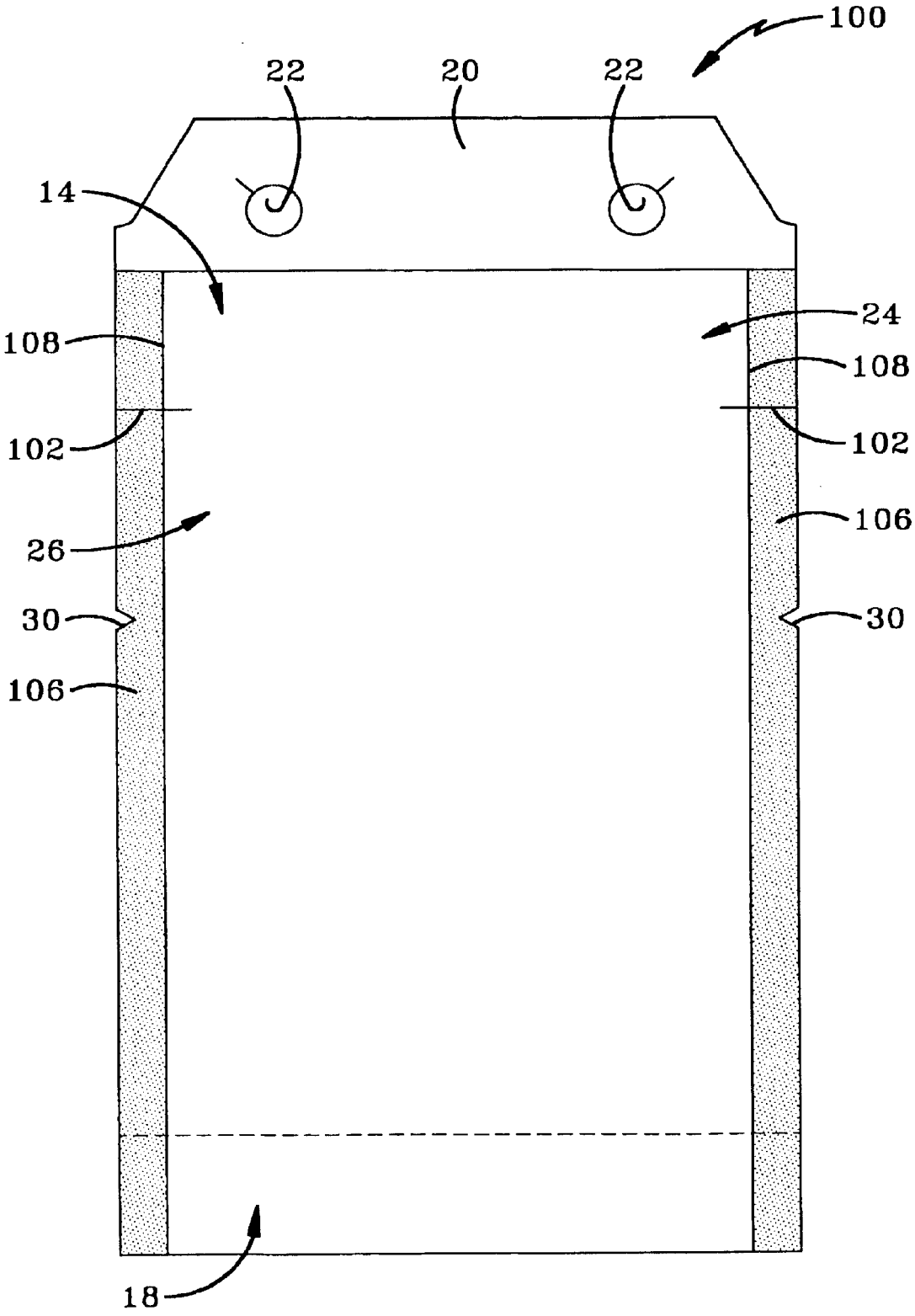
FIG. 9 is a front plan view of an alternative version of the bag of the present invention.

An alternative embodiment of the bag of the present invention is indicated generally by the numeral 100 in FIG. 9. Bag 100 is similar to bag 50 described above and the same numbers are used to refer to similar bag elements.

Bag 100 includes stress relief notches 102. Stress relief notches 102 function in a similar manner to stress relief notches 52 described above. In bag 100, each stress relief notch 102 is positioned above sealing area 26 such that sealing area 26 is intermediate stress relief notch 102 and tear notches 30. Each stress relief notch 102 is positioned intermediate sealing area 26 and an upper corner of bag 100.

In bag 100, each stress relief notch 102 extends entirely through a flange 106 and into neck 24. In FIG. 9, each stress relief notch 102 is in the form of a thin slit. In FIG. 9, the slit extends into neck area 24 a distance approximately equal to half of the width of flange 106. The distance may vary greatly from as small as simply nicking the edge of neck area 24 so that the longitudinal seal 108 is broken to a distance where the slits extend into neck area 24 two to four times the width of flange 106. Each stress relief notch 102 penetrates the pocket of bag 100 such that each stress relief notch 102 provides fluid communication between the inside of bag 100 and the outside of bag 100.

Figure 10:
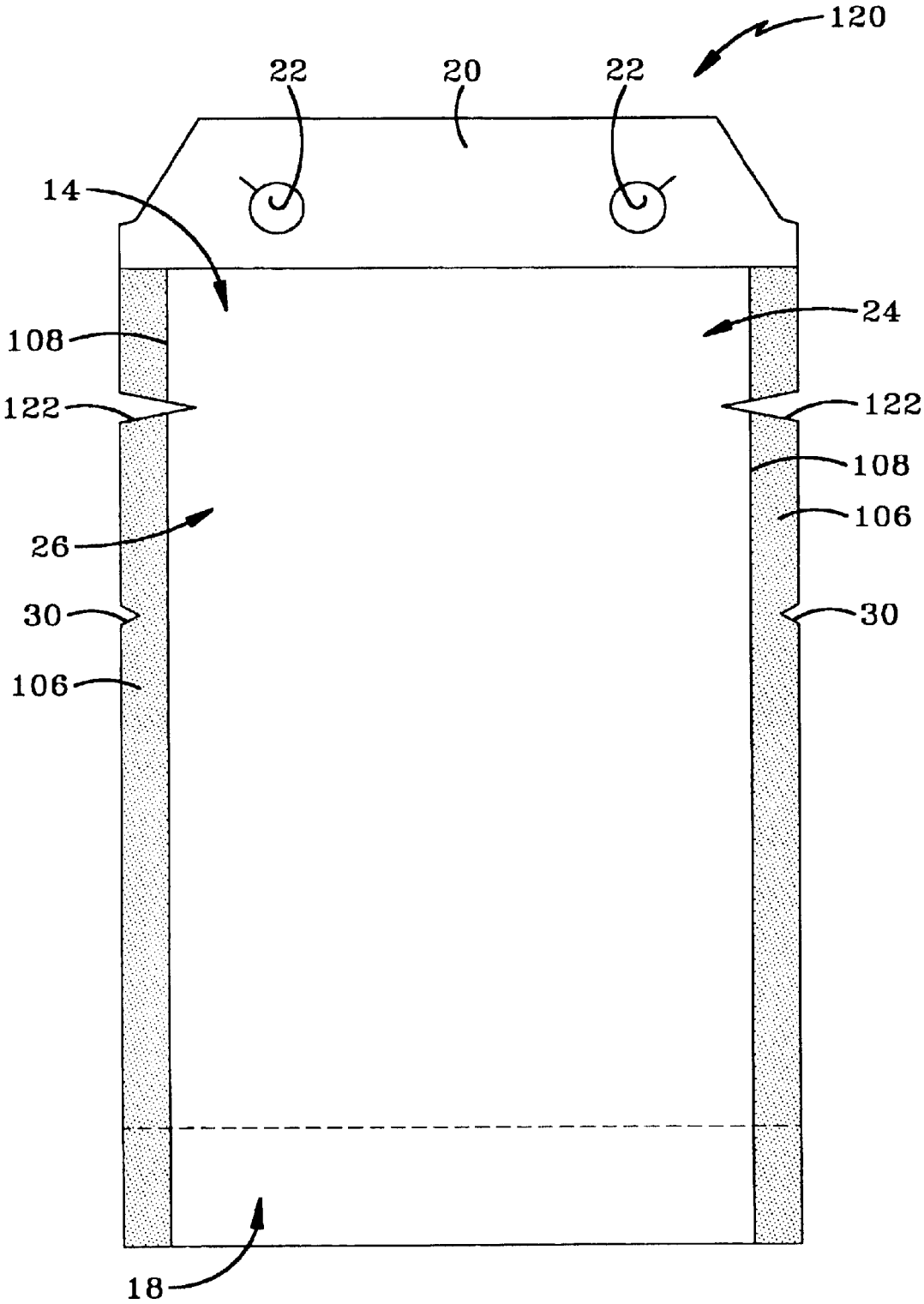
FIG. 10 is a view similar to FIG. 9 showing an alternative embodiment.

FIG. 10 discloses an alternative embodiment of the bag and indicates the bag generally by the numeral 120. Bag 120 defines a pair of stress relief notches 122 that extend into neck area 24. The size of each stress relief notch 122 is the same as described above but the shape is generally triangular with the wide end of the triangle being positioned at the outer edge of flange 106.

Figure 11:
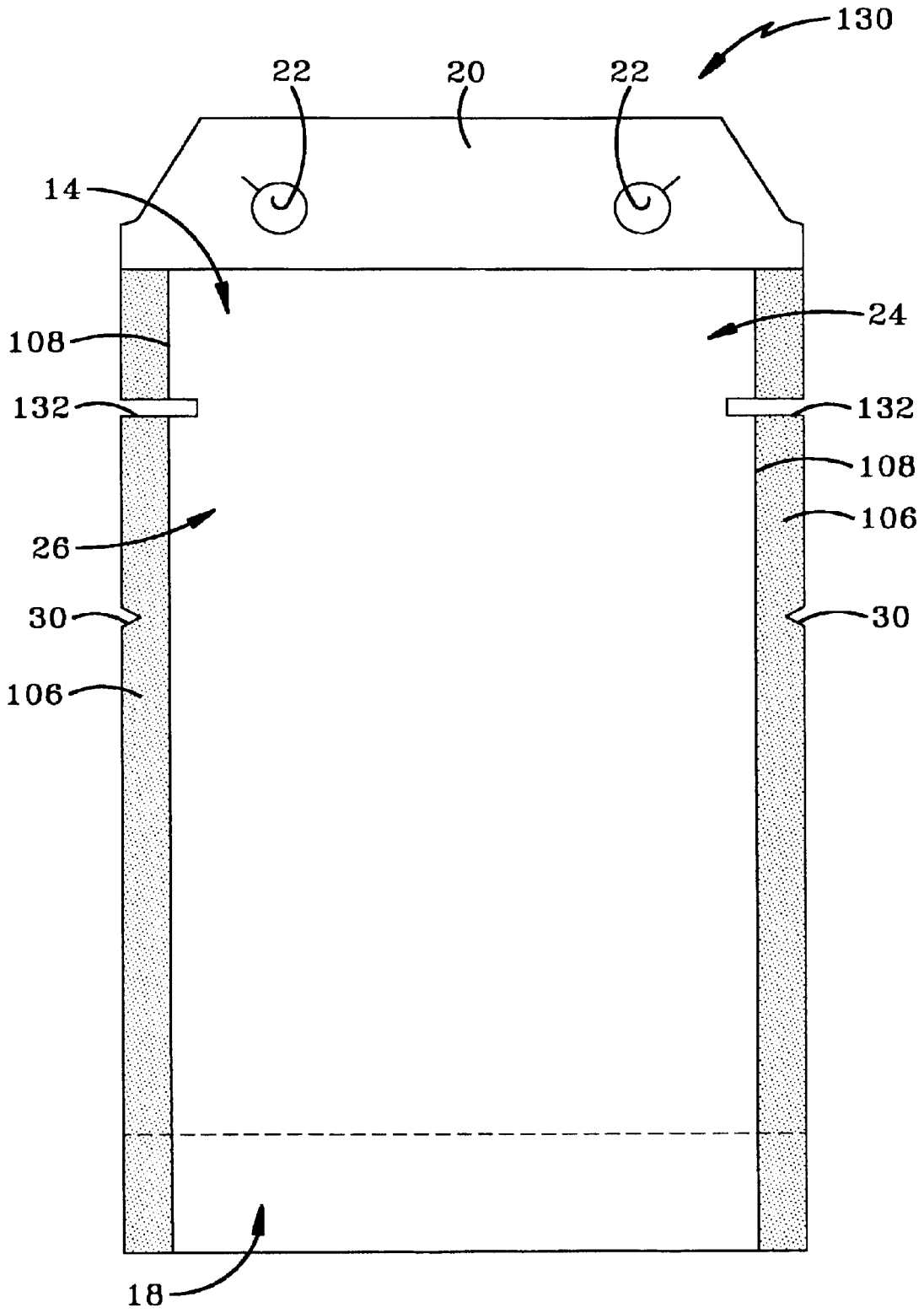
FIG. 11 is a view similar to FIG. 9 showing an alternative embodiment.

FIG. 11 discloses an alternative embodiment of the bag and indicates the bag generally by the numeral 130. Bag 130 defines a pair of stress relief notches 132 that extend into neck area 24. The size of each stress relief notch 132 is the same as described above but the shape is generally rectangular.

Figure 12:
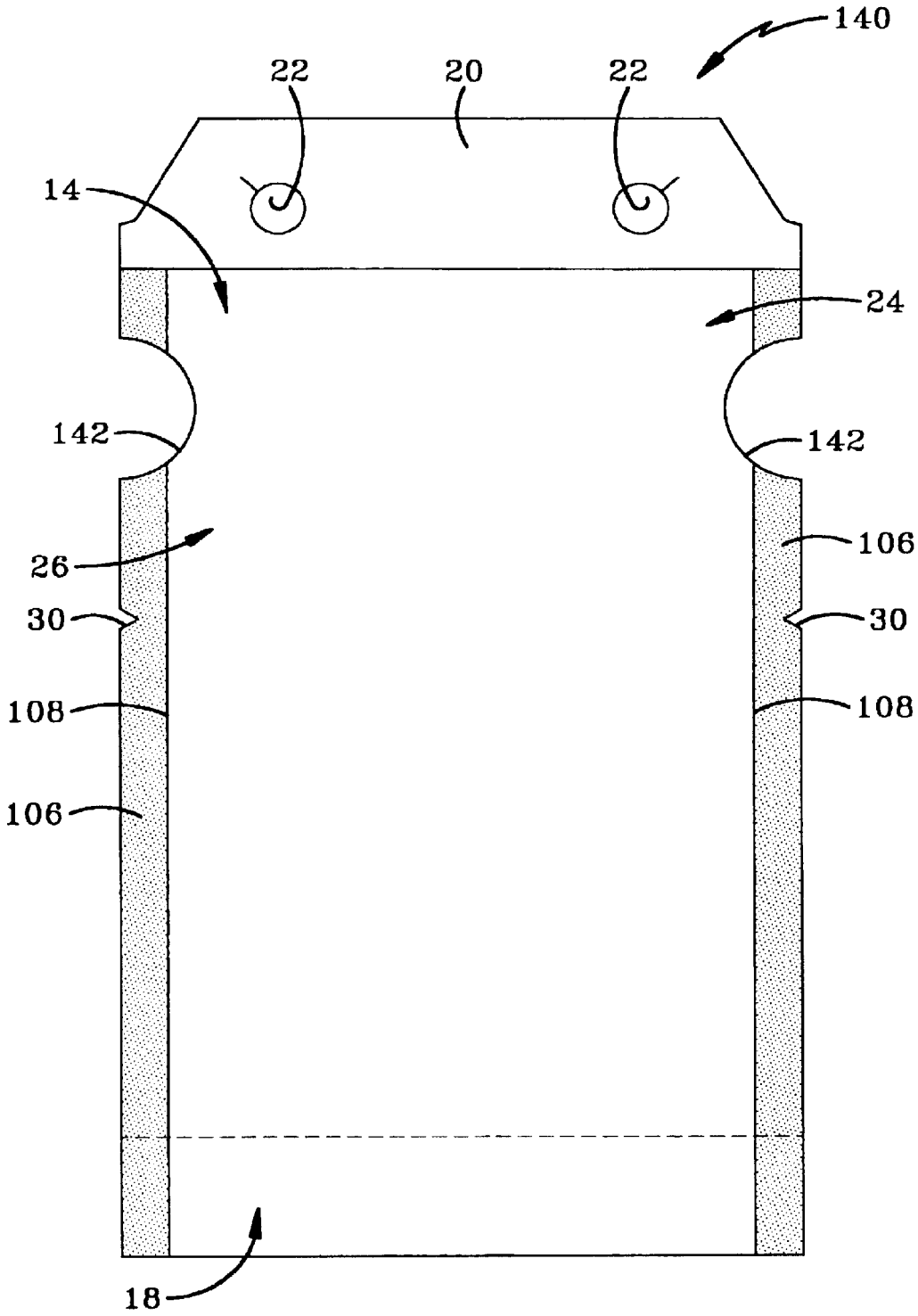
FIG. 12 is a view similar to FIG. 9 showing an alternative embodiment.

FIG. 12 discloses an alternative embodiment of the bag and indicates the bag generally by the numeral 140. Bag 140 defines a pair of stress relief notches 142 that extend into neck area 24. The size of each stress relief notch 142 is the same as described above but the shape is generally semi-circular with the wide end of the semi-circle being positioned at the outer edge of flange 106.

Figure 13:
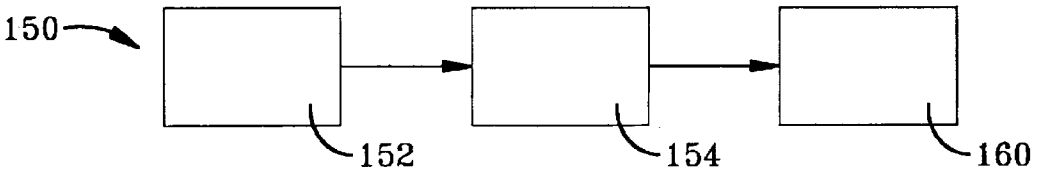
FIG. 13 is a schematic view of a manufacturing process used to form the bags of the invention.
Figure 14:
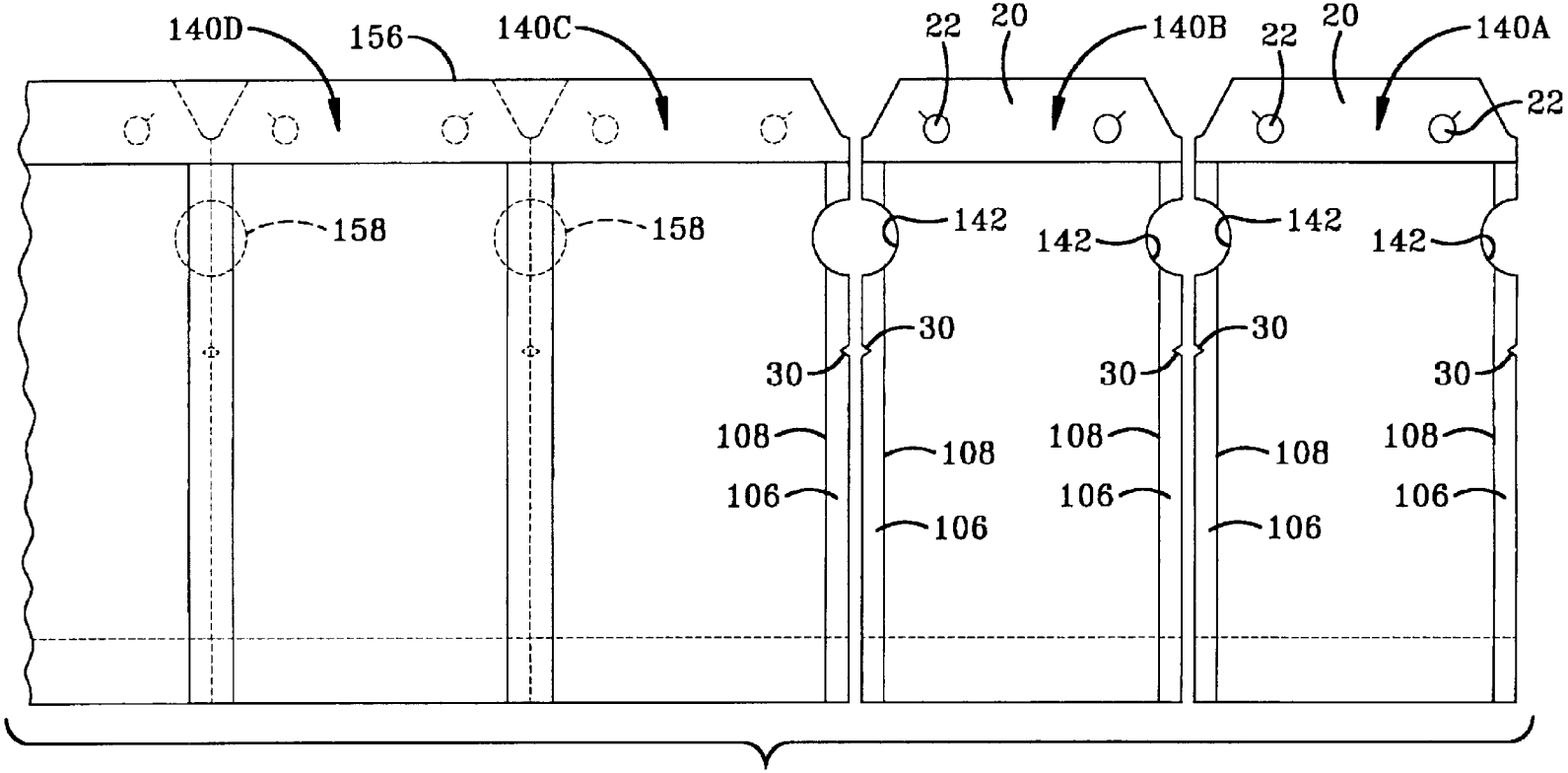
FIG. 14 is a view showing bags being cut from a continuous length of bag stock.

FIG. 13 schematically depicts a manufacturing process 150 that may be used to fabricate any of bags 50, 100, 120, 130, or 140. The process may include an assembly station 152 that forms the structure of the bags of processes known in the art of bag manufacturing. A cutting or stamping station 154 is positioned downstream which cuts the final shape into a continuous length of bag stock 156. A single cutting step may be used to cut stress relief notches on adjacent bags. In FIG. 14, a circular punch may be used at dashed lines 158 to simultaneously form a pair of stress relief notches 142 on adjacent bags 140A and 140B. A storage and collection station 160 is positioned downstream of stamping station 154 to collect the bags formed by the process.

Accordingly, the improved bag for automated filling and sealing machine apparatus is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the bag for automated filling and sealing machine is constructed and used, the characteristics of the construction, and the advantageous new and useful results obtained; the new and useful structures, devices, elements, arrangements, parts, and combinations are set forth in the appended claims.

What is claimed is:

1. A bag for storing merchandise, the bag comprising:

a body forming a pocket that is adapted to receive the merchandise;

the body having an upper sheet and a lower sheet;

the body having a pair of flanges disposed along the sides of the body where the upper and lower sheets are connected together;

the body having a sealing area where the upper and lower sheets are connected to close the pocket;

the body includes a pair of upper corners;

each of the flanges defining a stress relief notch; the sealing area being disposed intermediate the stress relief notches and the pocket;

each flange further defines a tear notch; the sealing area being disposed intermediate the tear notch and the stress relief notch;

each stress relief notch dividing the flange into an upper portion and a lower portion; the upper portion of the flange disposed intermediate the stress relief notch and the upper corner of the body;

a portion of the lower portion of the flange being disposed adjacent the sealing area of the body;

the upper portion of each flange adapted to fold over when the upper portion of each flange is grasped and pinched by the finger assemblies while the lower portion of each flange remains substantially undisturbed to prevent the sealing area from wrinkling; and each of the flanges has a width with each of the stress relief notches having a width in the range of 50 to 95 percent of the width of the flange.

2. The bag of claim 2, wherein the body includes a secondary seal; the tear notches being disposed intermediate the secondary seal and the sealing area.

3. The bag of claim 1, wherein the stress relief notches are disposed in a portion of the bag that is adapted to be removed after the bag is sealed.

4. The bag of claim 1, wherein each stress relief notch extends entirely through a flange.

5. The bag of claim 1, wherein the body includes a gusseted bottom.

6. The bag of claim 1, wherein each flange has a width of 0.25 inches and each stress relief notch has a width of 0.21875 inches.

7. The bag of claim 1, wherein each flange has a width of 0.375 inches and each stress relief notch has a width of 75 to 90 percent of the width of the flange.

8. A sealable bag for storing merchandise, the bag comprising:

a body having upper and lower sheets that form a pocket that is adapted to receive the merchandise;

the body having a pair of flanges disposed along the sides of the body where the upper and lower sheets are connected together;

the pocket having an upper opening extending between the flanges; merchandise being placed into the pocket through the upper opening;

the body including a pair of upper corners disposed adjacent the locations where the pocket opening meets the flanges;

the body having a sealing area where the upper and lower sheets are welded together to close the pocket;

each of the flanges defining a stress relief notch that extends through both the upper and lower sheets of the body; the stress relief notches being disposed intermediate the sealing area and the opening to the pocket;

the stress relief notches adapted to relieve stresses in the sealing area when the bag is gripped at the upper corners of the body; and a secondary seal; the sealing area being disposed intermediate the secondary seal and the stress relief notches; the stress relief notches being between the upper and the stress relief notches being located between the upper opening and both the secondary and the sealing area.

9. The bag of claim 8, wherein the body includes a gusseted bottom.

10. The bag of claim 8, wherein each of the stress relief notches is in the form of a thin slit.

11. The bag of claim 8, wherein each of the stress relief notches is in the form of a rectangle.

12. The bag of claim 8, wherein each of the stress relief notches is in the form of a triangle.

13. The bag of claim 8, wherein each of the stress relief notches is in the form of a semi-circle.

14. The bag of claim 8, wherein each flange defines a longitudinal seal at the edge of the flange and wherein each stress relief notch extends through the longitudinal seal.

* * * * *